US006699064B1

(12) United States Patent
Daoud et al.

(10) Patent No.: US 6,699,064 B1
(45) Date of Patent: Mar. 2, 2004

(54) CONNECTOR HOUSING DESIGN FOR STRAIN RELIEF OF WIRES

(75) Inventors: Bassel Daoud, Parsippany, NJ (US); George A. DeBalko, Long Valley, NJ (US); Antonio A. Figueiredo, Long Valley, NJ (US); Mikhail Sumetskiy, Bridgewater, NJ (US); Christopher M. Helmstetter, Bridgewater, NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/414,663

(22) Filed: Oct. 7, 1999

(51) Int. Cl.[7] ..... H01R 13/58

(52) U.S. Cl. ..... 439/456

(58) Field of Search ..... 439/456, 719

(56) References Cited

U.S. PATENT DOCUMENTS 5,363,440 A * 11/1994 Daoud ..... 379/413.02
5,885,112 A * 3/1999 Louwagie et al. ..... 439/719
5,929,381 A * 7/1999 Daoud ..... 439/719
5,930,111 A * 7/1999 Yamazaki et al. ..... 439/719

* cited by examiner

*Primary Examiner*—Renee Luebke
*Assistant Examiner*—Ann McCamey
(74) *Attorney, Agent, or Firm*—Birch, Stewart, Kolasch & Birch, LLP

(57) ABSTRACT

A connector assembly including at least one connector coupled to a connector housing and, at least one trough disposed on two opposing sides of the housing, such that a wire coupled to the at least one connector passes through both troughs. The troughs operate to reduce the strain on the wire by shifting forces on the wire away from a wire wrap section where the wire is coupled to the at least one connector.

21 Claims, 7 Drawing Sheets

CONNECTOR HOUSING DESIGN FOR STRAIN RELIEF OF WIRES

FIELD OF THE INVENTION

The present invention relates to a connector assembly, and in particular, a connector assembly which reduces strain on wires coupled to the connector assembly.

DESCRIPTION OF THE RELATED ART

There are various devices which exist for protecting electrical circuits from excessive voltages and/or currents. One such device for use with telecommunications systems is known in the field as an "building entrance protector", for example of the type produced by Lucent Technologies, Inc., of Murray Hill, N.J. Building entrance protectors typically couple the internal telecommunications lines (e.g. phone lines) of a building or other structure to the external telecommunications lines of a telecommunications provider. The building entrance protector shields the internal telecommunications lines from overvoltage and overcurrent conditions by shunting any excess voltage or current present on the external lines away from the internal lines.

FIG. 1 shows a side elevation view of a conventional building entrance protector 10. The building entrance protector 10 includes a housing 15 which is movable about joints 16, 17. Joint 17 defines upper 18 and lower 19 portions of the housing 15. The upper portion 18 of the housing 15 includes a plurality of output pins 20, each of which are coupled to a separate wire (e.g. wire 21) at a lower end 25 of the pins. The output pins 20 are all coupled to a connector assembly 27 which holds and retains the output pins. An upper end 26 of each output pin 20 is coupled to an internal telecommunications line (not shown) as explained in detail below. The wire or wires (e.g. wire 21) are bunched together into a wire bunch 22 and fed to the lower portion 19 of the housing 15 where each wire of the bunch is coupled to a lower end 35 of one of a respective plurality of input pins 30 by wire wrap. A plurality of plug-in protection devices 40 are coupled to an upper end 36 of the input pins 30. The plug-in protection devices 40 may be of a type described in U.S. Pat. No. 4,796,150 to Dickey et al., which is expressly incorporated by reference herein in its entirety. The protection devices 40 protect the input pins 30 from overvoltage and overcurrent conditions. External telecommunications lines (not shown) are coupled to the protection devices 40, and consequently input pins 30, as explained below.

In operation, internal telecommunications lines (not shown) of a building or other structure are coupled to the plurality of output pins 20, and the external telecommunications lines (not shown) of a telecommunications service provider are coupled to the plurality of input pins 30 through protection devices 40. During normal operation, telecommunications signals pass between the input pins 30 and output pins 20 without interruption. However, if an overvoltage or overcurrent condition is presented on one of the external lines, the excess voltage or current is shunted away from the input pins 30 by protection devices 40.

FIGS. 2(*a*)–2(*c*) show top, front and side elevation views, respectively, of the connector assembly 27. The connector assembly 27 is substantially rectangular and includes a plurality of output pins 20 coupled to an upper side 28 thereof. Each output pin 20 includes an upper 26 and lower 25 end. The upper end 26 of each output pin 20 includes a fastener (e.g. screw) for coupling to an internal telecommunications line as described above. The lower end 25 of each output pin 25 is coupled to a separate wire (e.g. wire 21) by a wire wrap. As described above, the wire or wires (e.g. wire 21) are gathered together into a wire bunch 22 and led to the bottom portion 19 of the housing 15.

A problem associated with the above-described building entrance protector 10 is that the wire(s) (e.g. wire 21) often experience strains due to, for example, the opening and closing of the housing about joint 17. More particularly, as the building entrance protector 10 is opened and closed about joint 17, the wire(s) of the bunch 22 are often pulled away from the lower end 25 of the respective output pins 20 due to the force exerted on the end of the wire(s) closest to the joint 17 by the opening and closing of the building entrance protector. The strain on the wire(s) caused by this force often causes the wire(s) to become separated from the lower end 25 of output pins 20 at the point where the wire wrap is the weakest. The separation of the wire(s) from the lower end 25 of the output pins 20 breaks the connection between the input 30 and output 20 pins, and results in malfunctions of the building entrance protector 10.

Thus, there is currently a need for an improved building entrance protector which prevents the guillotine of wires.

SUMMARY OF THE INVENTION

The present invention is a connector assembly including at least one connector coupled to a connector housing; and, at least one trough disposed on two opposing sides of the housing, wherein a wire coupled to the at least one connector passes through both troughs.

The above and other advantages and features of the present invention will be better understood from the following detailed description of the preferred embodiments of the invention which is provided in connection with the accompanying drawings.

BRIEF DESCRIPTION OF THE DRAWINGS

FIG. 2(*b*) is a front elevation view of the conventional connector assembly shown in FIG. 2(*a*).

FIG. 2(*c*) is a side elevation view of the conventional connector assembly shown in FIG. 2(*a*).

FIG. 3(*b*) is a front elevation view of the connector assembly shown in FIG. 3(*a*).

FIG. 3(*c*) is a side elevation view of the connector assembly shown in FIG. 3(*a*).

DETAILED DESCRIPTION

Figure 3A:
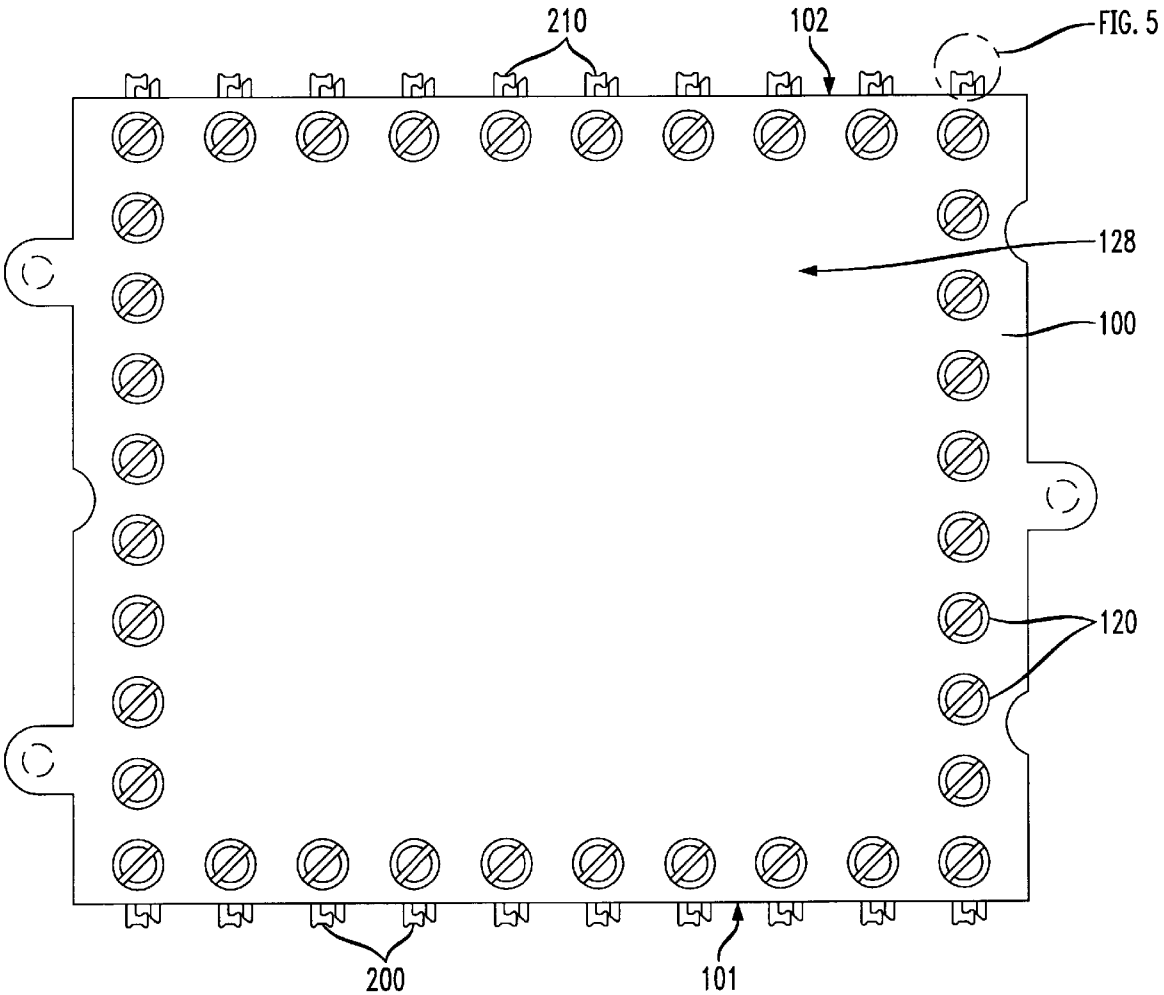
FIG. 3(*a*) is a top plan view of a connector assembly according to an exemplary embodiment of the present invention.
Figure 3B:
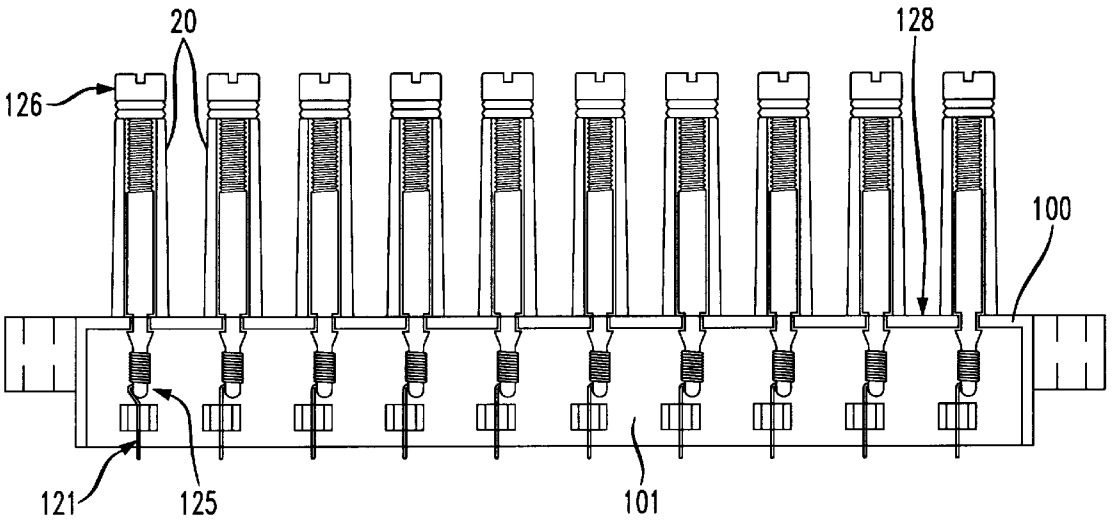
Figure 3C:
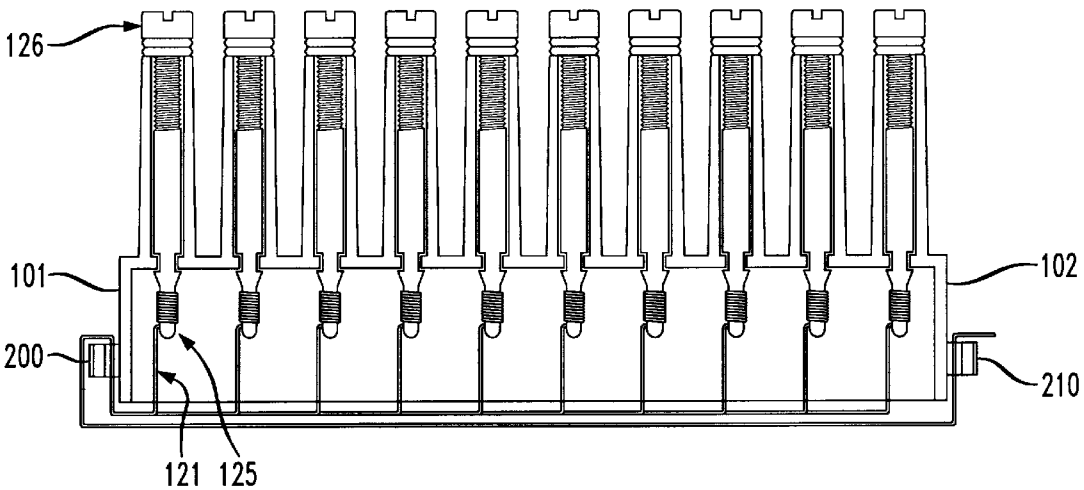

FIGS. 3(*a*)–3(*c*) and 4, show top, front and side elevation views, respectively, of a connector assembly 100 according to an exemplary embodiment of the present invention. Preferably, the connector assembly 100 is utilized in a building entrance protector device, such as the one shown in FIG. 1, however, the connector assembly 100 may be used in any application which couples one or a plurality of terminals to each another. The connector assembly 100 may be substantially rectangular, and preferably includes a plurality of output pins 120 coupled to an upper side 128 thereof. Each output pin 120 includes an upper 126 and lower 125 end. The upper end 126 of each output pin 120 includes a fastener (e.g. screw) for coupling to an internal telecommunications line (not shown). The lower end 125 of each output pin 120 is coupled to a separate wire (e.g. wire 121, shown in FIG. 5) by a wire wrap. The wire or wires (e.g. wire 121) of the output pins 120 are gathered together into a wire bunch 122 (shown in FIG. 5) for coupling to a plurality of input pins (e.g. pins 30 in FIG. 1).

The connector assembly 100 also includes a fist plurality of troughs 200 disposed along a front wall 101 of the connector assembly, and a second plurality of troughs 210 disposed along a rear wall 102 of the connector assembly. The particular structure of the troughs 200 is explained below with reference to FIG. 5. The troughs 200, 210 guide the wire(s) (e.g. wire 121) of the output pins 120 in order to reduce strain on the wire wrap connections disposed at the lower ends 125 of the output pins. It is noted that the output pins 120 are arranged in parallel rows 129 extending from the front wall 101 of the connector assembly 100 to a rear wall 102 of the connector assembly between one pair of troughs 200, 210. Although only the rows 129 on the edges of the connector assembly 100 are shown in FIG. 3(*a*), it should be understood that the exemplary connector assembly 100 includes ten (10) such rows, for a total of one hundred (100) output pins 120. In the exemplary embodiment, each pair of troughs 200, 210 guides ten (10) wires (i.e. one wire for each of the output pins 120 disposed between each pair of troughs). Any number of output pins 120 may be included in each row 129, and the size of each trough may be adjusted to accommodate any desired number of wires.

Figure 4:
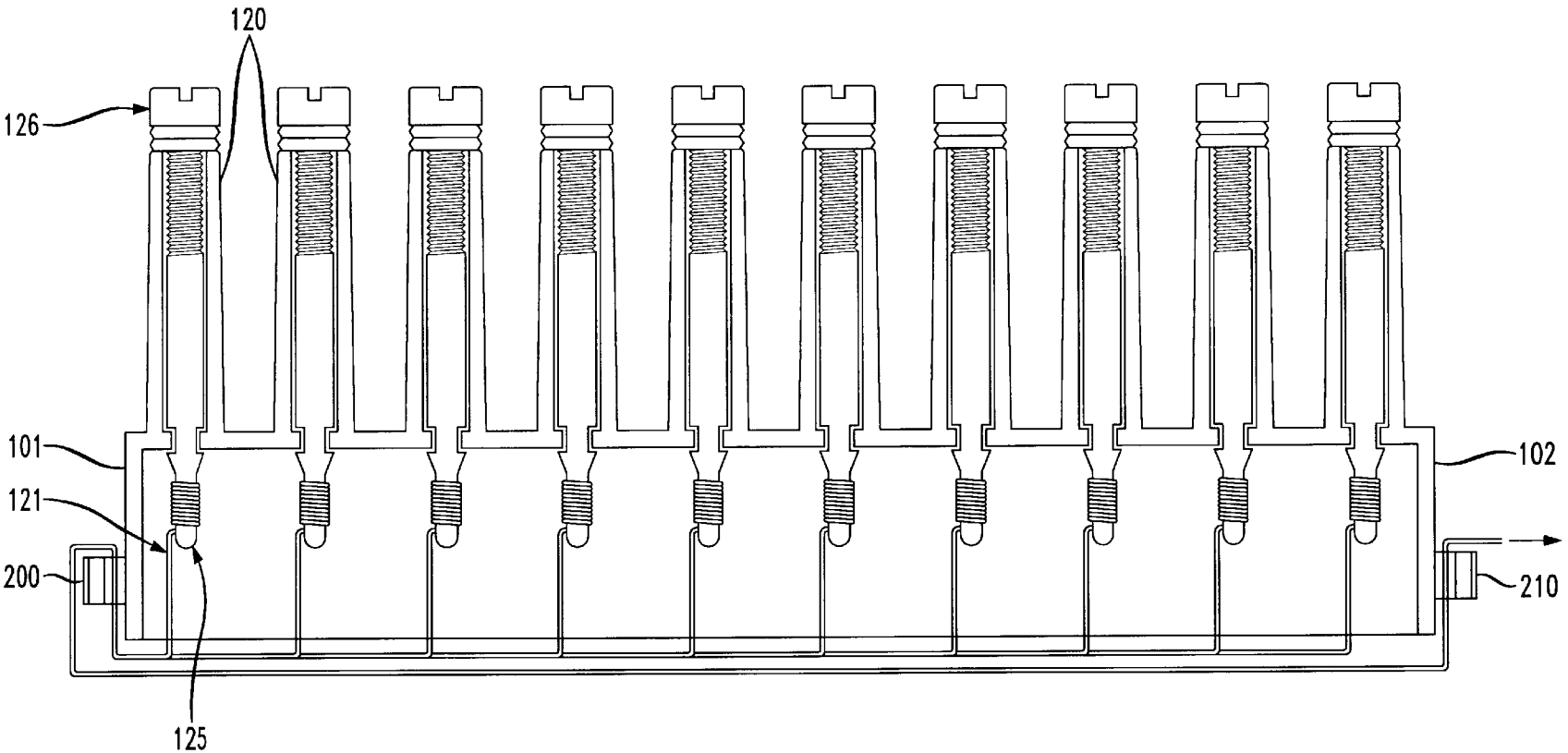
FIG. 4 is a magnified view of the side elevation view shown in FIG. 3(*c*).

As shown in FIG. 4, the wire(s) (e.g. wire 121) are led from each respective output pin 120 up through the first plurality of troughs 200 from the bottom, and then around a front face of the troughs. The wire(s) are then led along the bottom of the connector assembly 100 to the second plurality of troughs 210. The wire(s) are led up through the second plurality of troughs 210 from the bottom and away towards a plurality of input pins (e.g. input pins 30 of building entrance protector 10 shown in FIG. 1).

Thus, with the connector assembly 100 described above, forces exerted on the wire(s) (e.g. wire 121) by, for example, the opening and closing of the building entrance protector, do not produce substantial strains on the wire wrap connections disposed at the lower ends 125 of the output pins 120. This is because the strains are "absorbed" by the troughs 200, 210. In other words, the weaving of the wire(s) through the troughs 200, 210 places most of the strains (resulting from forces on the wire) on the troughs, and not on the wire wraps. Accordingly, the connector assembly 100 according to the exemplary embodiment of the present invention substantially reduces wire strain and prevents the wire(s) from becoming separated from the output pins 120.

Figure 5:
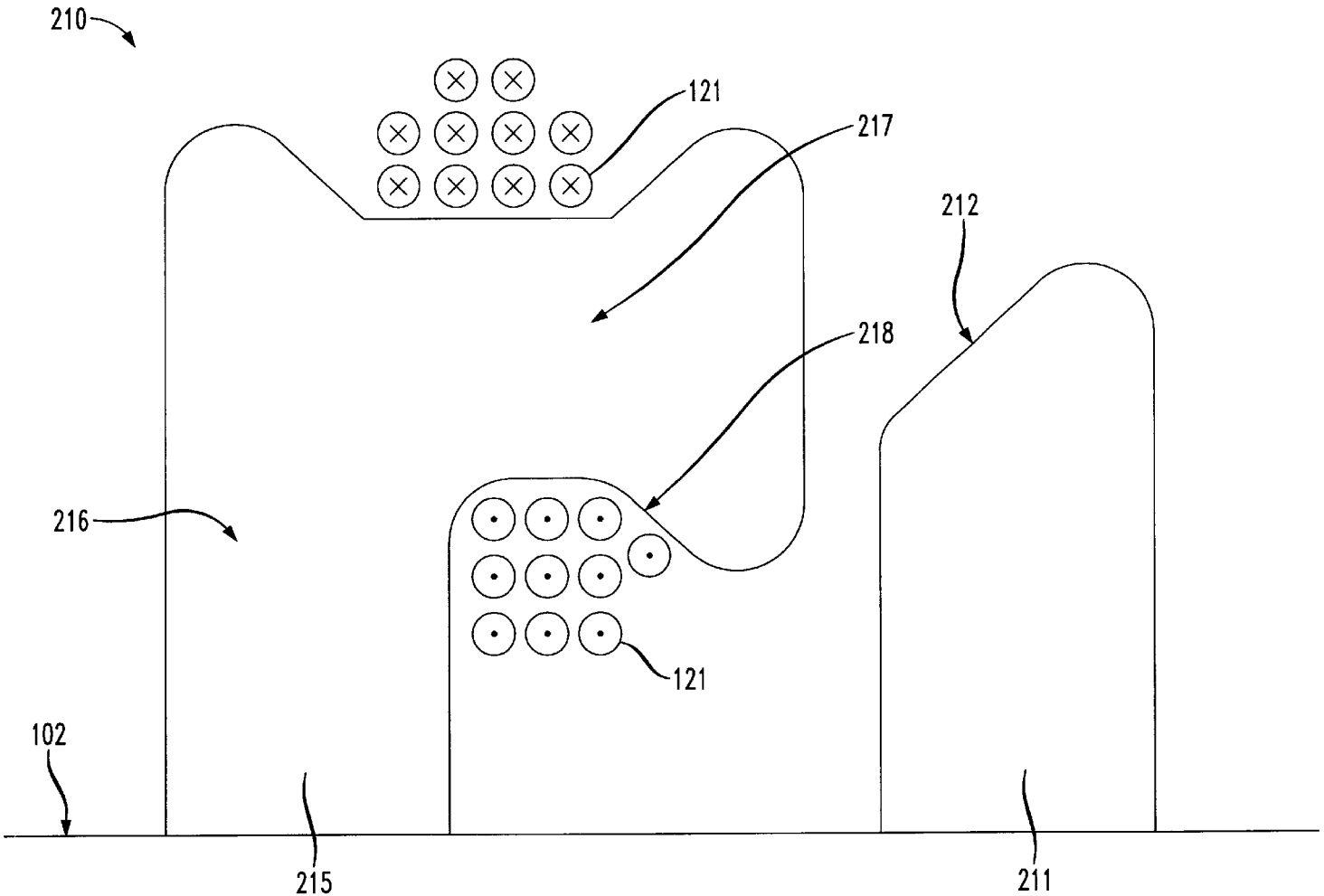
FIG. 5 is a magnified view of one of the troughs of the connector assembly shown in FIG. 3(*a*).

FIG. 5 shows a magnified view of one of the second plurality of troughs 210 of the connector assembly 100. The trough 210 includes a first member 211 which is substantially orthogonal to the rear wall 102 of the connector assembly. The first member 211 also includes an upper surface 212 which is preferably angled to allow easy insertion of a wire or wires (e.g. wire 121). However, it should be noted that the upper surface 212 may be of any suitable shape. The trough 210 also includes a second member 215 which is substantially "r"-shaped with a portion 216 which is orthogonal to the rear wall 102 of the connector assembly 100 and a portion 217 which is substantially parallel to the rear wall 102. A surface 218 of the portion 217 is preferably curved for cradling the wire(s) (e.g. wire 121). As explained above with reference to FIG. 4, the wire(s) (e.g. wire 121) come up from underneath the trough 210 as indicated by the dots in the center of the wire(s) (indicating that the wire comes out of the page). The wire(s) are then led over the portion 217 of the second member 215 and back into the page as indicated by the "x" in the center of the wire(s). From there the wire(s) are led to a plurality of input pins (e.g. input pins 30 of building entrance protector 10 shown in FIG. 1), as discussed above.

Figure 1:
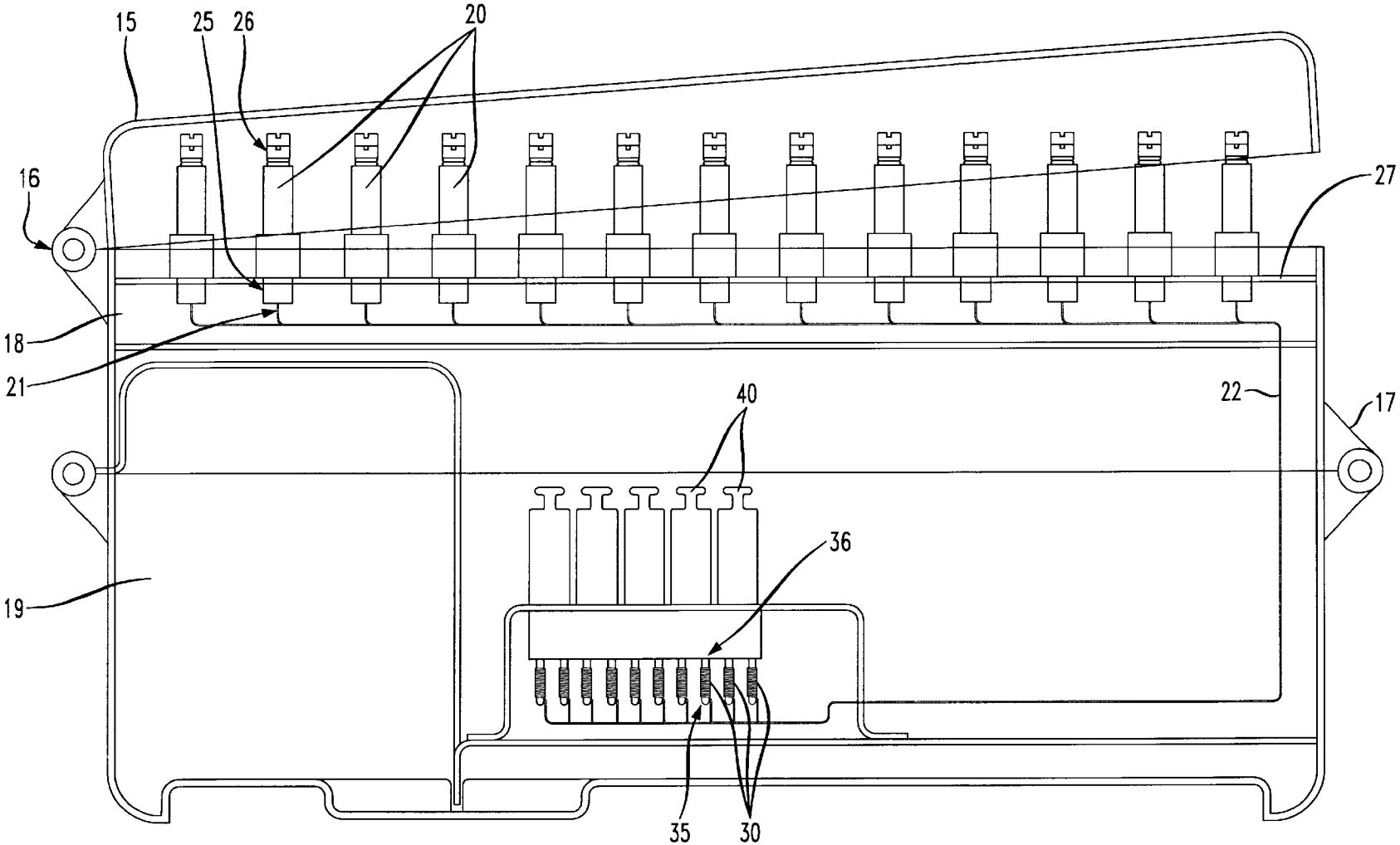
FIG. 1 PRIOR ART
FIG. 1 is a side elevation view of a conventional building entrance protector.
Figure 2A:
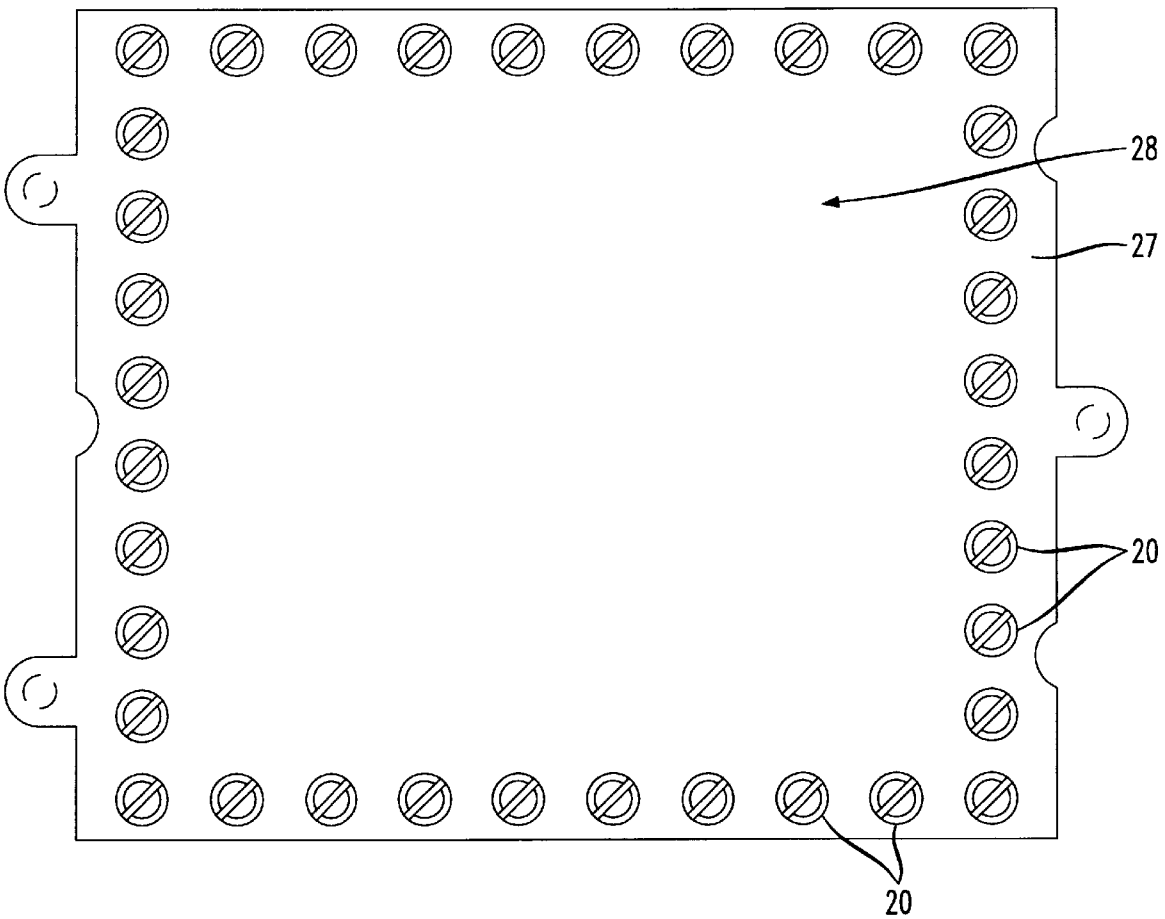
FIG. 2A PRIOR ART
FIG. 2(*a*) is a top plan view of a conventional connector assembly of the building entrance protector shown in FIG. 1.
Figure 2B:
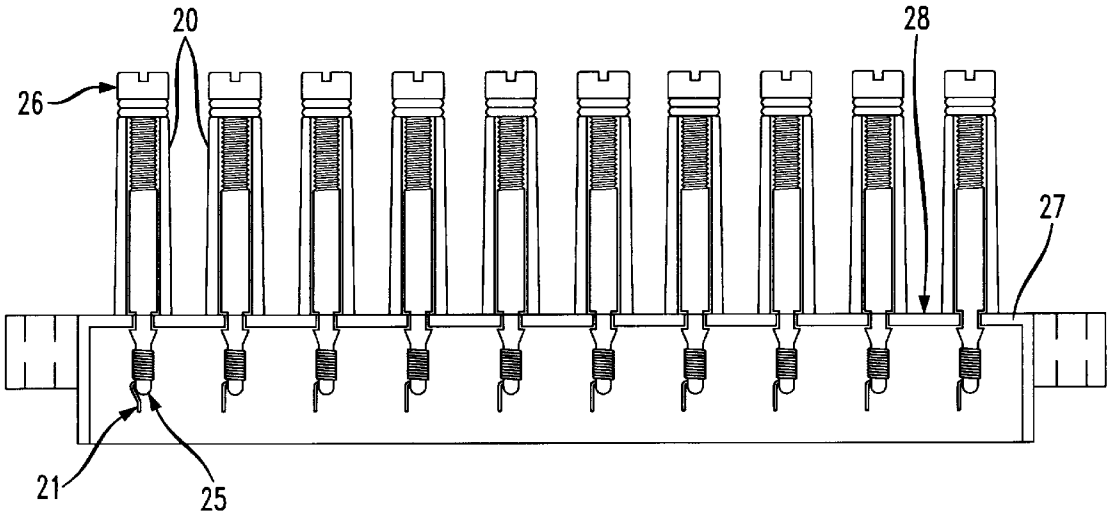
FIG. 2B PRIOR ART
Figure 2C:
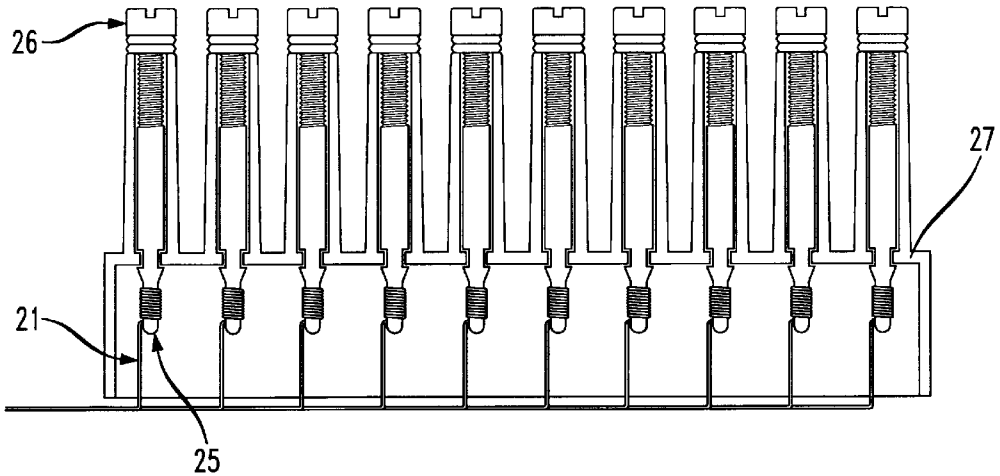
FIG. 2C PRIOR ART

Although the connector assembly 100 described above uses troughs to provide strain relief to wires coupled to a plurality of output pins 120, the connector assembly may alternatively provide strain relief to a plurality of input pins (such as input pins 30, FIG. 1). Further, although the connector assembly 100 is discussed above as including wire wrap connections for coupling the pins (e.g. pins 120) to respective wires (e.g. wire 121), the wires may be coupled to the pins by any other means know to those skilled in the art (e.g. solder). Additionally, although the above description discusses separate wires (e.g. wire 121) coupling each of the output pins 120 to a each of the input pins 130, the plurality of output pins may alternatively be coupled to the plurality of input pins by a single ribbon-wire connector.

Although the exemplary input terminals are of the pin type 120, other types of input connectors may be used, such as for example, a mini-rocker connector manufactured by the Egerton Company of Cheshire, England or a barrel type connector manufactured by the 3M Corporation of St. Paul, Minn.

Although the invention has been described in terms of exemplary embodiments, it is not limited thereto. Rather, the appended claims should be construed broadly, to include other variants and embodiments of the invention which may be made by those skilled in the art without departing from the scope and range of equivalents of the invention.

What is claimed is:

1. A connector assembly comprising:

a connector board having a first face and a second face, and a first side and a second side bordering said first and second faces, wherein said second face is opposite said first face and said second side is opposite said first side;

a plurality of connectors attached to said connector board, each connector having a first terminal projecting from said first face for electrical connection to a first wire, and each connector having a second terminal, electrically connected to said first terminal, projecting from said second face for electrical connection to a second wire;

a first trough attached to said first side; and a second trough attached to said second side, wherein wires electrically connected to one or more of said second terminals can engage said first trough and said second trough to provide strain relief to electrical connections between the wires and said second terminals, wherein said first trough includes:

a first part extending from said first side;

a second part extending from said first side and forming a cradle facing toward said first side; and a gap formed between said first part and said second part, wherein said gap is of sufficient size to enable a wire to pass therethrough and into said cradle of said second part.

2. The assembly according to claim 1, further comprising:

a housing including an first portion and a second portion which cooperate to substantially enclose said connector board; and a hinge connecting said first portion to said second portion, such that said connectors are accessible when said first portion is rotated away from said second portion to open said housing, and wherein said second trough is located proximate said hinge for providing strain relief to the wires when said housing is open.

3. The assembly according to claim 1, wherein said plurality of connectors form a row between said first trough and said second trough.

4. The assembly according to claim 1, wherein said connector board is substantially flat and substantially rectangular in shape.

5. The assembly according to claim 1, further comprising:

a third trough attached to said first side; and a fourth trough attached to said second side, wherein wires electrically connected to one or more of said second terminals can engage said third trough and said fourth trough to provide strain relief to electrical connections between the wires and said second terminals.

6. The assembly according to claim 5, wherein said plurality of connectors form a first row between said first trough and said second trough, and a second row between said third trough and said fourth trough.

7. The assembly according to claim 5, further comprising:

a housing including an first portion and a second portion which cooperate to substantially enclose said connector board; and a hinge connecting said first portion to said second portion, such that said connectors are accessible when said first portion is rotated away from said second portion to open said housing, and wherein said second trough and said fourth trough are located proximate said hinge for providing strain relief to the wires when said housing is open.

8. A connector assembly comprising:

a connector board having a first face and a second face, and a first side and a second side bordering said first and second faces, wherein said second face is opposite said first face and said second side is opposite said first side;

a plurality of connectors attached to said connector board, each connector having a first terminal projecting from said first face, and each connector having a second terminal, electrically connected to said first terminal, projecting from said second face;

a first trough attached to said first side;

a second trough attached to said second side; and a plurality of wires, each wire being electrically connected to one of the second terminals and engaging said first trough and said second trough to provide strain relief to said electrical connection between said wire and said second terminal.

9. The assembly according to claim 8, further comprising:

a housing including an first portion and a second portion which cooperate to substantially enclose said connector board; and a hinge connecting said first portion to said second portion, such that said connectors are accessible when said first portion is rotated away from said second portion to open said housing, and wherein said second trough is located proximate said hinge for providing strain relief to said wires when said housing is open.

10. The assembly according to claim 8, wherein said plurality of connectors form a row between said first trough and said second trough.

11. The assembly according to claim 8, wherein said connector board is substantially flat and substantially rectangular in shape.

12. The assembly according to claim 8, wherein said first trough includes:

a first part extending from said first side;

a second part extending from said first side and forming a cradle facing toward said first side; and a gap formed between said first part and said second part, wherein said gap is of sufficient size to enable at least one of said wires to pass therethrough and into said cradle of said second part.

13. The assembly according to claim 8, further comprising:

a third trough attached to said first side; and a fourth trough attached to said second side, wherein said wires electrically connected to said second terminals can engage said third trough and said fourth trough to provide strain relief to said electrical connections between said wires and said second terminals.

14. The assembly according to claim 13, wherein said plurality of connectors form a first row between said first trough and said second trough, and a second row between said third trough and said fourth trough.

15. The assembly according to claim 13, further comprising:

a housing including an first portion and a second portion which cooperate to substantially enclose said connector board; and a hinge connecting said first portion to said second portion, such that said connectors are accessible when said first portion is rotated away from said second portion to open said housing, and wherein said second trough and said fourth trough are located proximate said hinge for providing strain relief to said wires when said housing is open.

16. A method of providing strain relief to an electrical connection comprising the steps of:

providing a connector board having a first face and a second face, and a first side and a second side, wherein the second face is opposite the first face and the second side is opposite the first side; a plurality of connectors attached to the connector board, each connector having a first terminal projecting from the first face, and each connector having a second terminal, electrically connected to the first terminal, projecting from the second face; a first trough attached to the first side; and a second trough attached to the second side;

electrically connecting an end of a wire to the second terminal of one of the plurality of connectors; and engaging the wire within the first trough and then engaging the wire within the second trough, in order to provide strain relief to the electrical connection between the wire and the second terminal.

17. The method of claim 16, wherein said step of electrically connecting includes wire wrapping the end of the wire to the second terminal.

18. The method of claim 16 further comprising:

electrically connecting another end of the wire to a surge protection device.

19. The method of claim 16, wherein said step of engaging the wire within the first trough includes passing a side of the wire through a gap formed in the first trough and into a cradle formed in the first trough.

20. The method of claim 16, further comprising the step of:

engaging the wire to an external surface of the first trough prior to engaging the wire within the second trough.

21. The method of claim 16, further comprising the step of:

engaging the wire to an external surface of the first trough after engaging the wire within the first trough and prior to engaging the wire within the second trough.

* * * * *